US006415700B1

(12) United States Patent
Hunn et al.

(10) Patent No.: US 6,415,700 B1
(45) **Date of Patent: *Jul. 9, 2002**

(54) DROP SPEED ADJUSTMENT ASSEMBLY FOR A BREAD SLICER

(75) Inventors: Robert W. Hunn, South Bend; Hardev S. Somal, LaPorte, both of IN (US)

(73) Assignee: Illinois Tool Works Inc., Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/507,715

(22) Filed: Feb. 18, 2000

(51) Int. Cl.[7] ..... B26D 5/12; B26D 7/22

(52) U.S. Cl. ..... 83/647; 83/759; 83/800; 83/599; 83/DIG. 1; 83/932

(58) Field of Search ..... 83/932, DIG. 1, 83/407, 584, 585, 589, 599, 647, 800, 808, 759

(56) References Cited

U.S. PATENT DOCUMENTS

| | | | | | |
|---|---|---|---|---|---|
| 1,372,903 | A | * | 3/1921 | Perkins et al. | 83/800 |
| 2,300,047 | A | * | 10/1942 | Jensen et al. | 83/647 X |
| 2,315,767 | A | | 4/1943 | Brutowsky | 83/70 |
| 2,822,004 | A | * | 2/1958 | Rudolph | 83/407 X |
| 3,140,634 | A | * | 7/1964 | McDaniel, Jr. | 83/599 X |
| 3,204,506 | A | * | 9/1965 | Reinhold | 83/DIG. 1 X |
| 3,288,008 | A | * | 11/1966 | Stolzer | 83/647 X |
| 3,492,902 | A | * | 2/1970 | Stolzer | 83/589 |
| 3,731,577 | A | * | 5/1973 | Swint, Jr. | 83/599 |
| 3,991,644 | A | * | 11/1976 | Sugimoto | 83/800 |
| 3,996,782 | A | * | 12/1976 | Sgariglia | 83/589 X |
| 4,015,500 | A | * | 4/1977 | Stolzer | 83/647 X |
| 4,262,564 | A | * | 4/1981 | Kaltenbach | 83/589 X |
| 4,296,661 | A | * | 10/1981 | Kaneko | 83/800 X |
| 4,363,254 | A | * | 12/1982 | Aizawa et al. | 83/800 |
| 4,481,845 | A | * | 11/1984 | Sakurai et al. | 83/800 X |
| 4,534,247 | A | * | 8/1985 | Taguchi | 83/800 X |
| 4,576,074 | A | * | 3/1986 | Van der Togt | 83/DIG. 1 X |
| 4,662,257 | A | | 5/1987 | Petersen et al. | 83/407 |
| 4,913,014 | A | * | 4/1990 | Missler | 83/800 X |
| 5,052,255 | A | * | 10/1991 | Gaines | 83/DIG. 1 X |
| 5,287,781 | A | * | 2/1994 | Fehr et al. | 83/932 X |
| 6,170,373 | B1 | * | 1/2001 | Sasaki et al. | 83/DIG. 1 X |
| 6,192,779 | B1 | * | 2/2001 | Hartmann | 83/932 X |

OTHER PUBLICATIONS

Berkel Owner/Operator Manual for Model MB Slicer consisting of 13 pages.

* cited by examiner

*Primary Examiner*—Charles Goodman
(74) *Attorney, Agent, or Firm*—Mark W. Croll; Donald J. Breh; Lisa M. Soltis

(57) ABSTRACT

A bread slicer that has a knife frame, a damper and a variable rate control. The knife frame is movable between first and second positions. The damper is coupled to the knife frame and is configured to affect the rate of movement of the knife frame. The variable rate control assembly has an actuator coupled with the damper to selectively affect the rate of movement of the knife frame.

19 Claims, 6 Drawing Sheets

DROP SPEED ADJUSTMENT ASSEMBLY FOR A BREAD SLICER

TECHNICAL FIELD

The present invention relates to a bread slicer. More particularly, the present invention relates to a drop speed adjustment assembly for the knife frame of an industrial bread slicer.

BACKGROUND ART

Industrial bread slicers are known in the art. A conventional industrial bread slicer includes a plurality of knives carried by a knife frame which surrounds a bread tray or similar support that holds a loaf of bread. The knife frame is elevated above the bread tray and the loaf of bread is placed onto the tray. After the bread is positioned in the tray, the knife frame is allowed to descend under the force of gravity. The knives are motor driven and movable through the loaf tray in a direction transverse of the loaf thereby dividing the loaf into slices. Use of a piston pump or dashpot provides resistance against the moving knife tray creating a more controlled descent making a smoother slice through the loaf.

It would be desirable to have a bread slicer that included a drop speed adjustment assembly having a variable rate control to adjust different rates with which the knife frame drops. This creates a smooth slice for any of a variety of breads of different densities. It would also be desirable for the drop speed adjustment assembly to be accessible to an operator only when the bread slicer is in a non-operable position for safety purposes.

DISCLOSURE OF THE INVENTION

According to the following, as well as further embodiments of the present invention which will become apparent as the description thereof proceeds below, the present invention provides a bread slicer comprising a knife frame, a damper and a variable rate control. The knife frame is movable between first and second positions. The damper is coupled to the knife frame and is configured to affect the rate of movement of the knife frame. The variable rate control assembly has an actuator coupled with the damper to selectively affect the rate of movement of the knife frame.

Another embodiment of the present invention provides a bread slicer comprising a knife frame and a variable rate control assembly. The variable rate control assembly is in operable communication with the knife frame and configured to selectively vary the rate of movement of the knife frame.

A further embodiment of the present invention provides a bread slicer comprising a knife frame, a dashpot and a variable rate control assembly. The dashpot is coupled to the knife frame and configured to affect the rate of movement of the knife frame. The variable rate control assembly is in operable communication with the knife frame and is configured to selectively vary the rate of movement of the knife frame.

A still further embodiment of the present invention also provides a bread slicer comprising a knife frame, a dashpot and a variable rate control assembly. In this embodiment, the variable rate control assembly is in operable communication with the dashpot and comprises an actuator movably attached to the knife frame; a valve in operable communication with the dashpot and configured to vary the rate of movement of the knife frame; and a shaft in operable communication with the actuator and the valve such that selective movement of the actuator causes the valve to selectively vary the rate of movement of the knife frame.

An even still further embodiment of the present invention provides a variable rate control assembly for a bread slicer having a damper configured to affect a rate of movement made by the bread slicer. The variable rate control assembly comprises an actuator, a valve and a shaft. The actuator is movably attached to the bread slicer. The valve is provided in operable communication with the dashpot and configured to vary the rate of movement of the bread slicer. The shaft is provided in operable communication with the actuator and the valve such that selective movement of the actuator causes the valve to selectively vary the rate of movement of the bread slicer.

In various embodiments of the present invention, the bread slicer also comprises a cover configured to conceal the variable rate control assembly. In addition, the bread slicer may include an actuator or knob that is at least partially extended through an aperture in the cover when the knife frame is in the second (rested) position, and concealed by the cover when the knife frame is in the first (elevated) position. The actuator or knob may also be movable to a plurality of positions.

The damper can be a dashpot and may have first and second portions. The variable rate control assembly can be configured to selectively vary the rate by which fluid is distributed between said portions.

Additional features of the invention will become apparent, to those skilled in the art, upon consideration of the following detailed description exemplifying the best mode of carrying out the invention as presently perceived.

BRIEF DESCRIPTION OF DRAWINGS

The present invention will be described hereafter with reference to the attached drawings which are given as non-limiting examples only, in which.

Corresponding reference characters indicate corresponding parts throughout the several views. The exemplification set out herein illustrates an embodiment of the invention, in one form, and such exemplification is not to be construed as limiting the scope of the invention in any manner.

DETAILED DESCRIPTION OF THE DRAWINGS

The present invention is directed to a speed adjustment assembly for a bread slicer having a variable rate control assembly that allows the operator to change the rate with which the knife frame drops as a loaf is being sliced. In addition, the drop speed adjustment assembly is accessible to the operator only when the bread slicer is in its non-operable position. This is to prevent the operator from attempting to change the drop speed adjustment assembly when the bread slicer is in use thereby increasing the possibility of injury.

Conventional bread slicers suitable for use with the present invention illustratively comprise five major body structures. Those structures include a base frame, a knife frame, a loaf tray, a drive mechanism and a housing. An example of a conventional industrial bread slicer is described in U.S. Pat. No. 2,315,767, entitled BREAD SLICING MACHINE (hereinafter the '767 patent).

Figure 1:
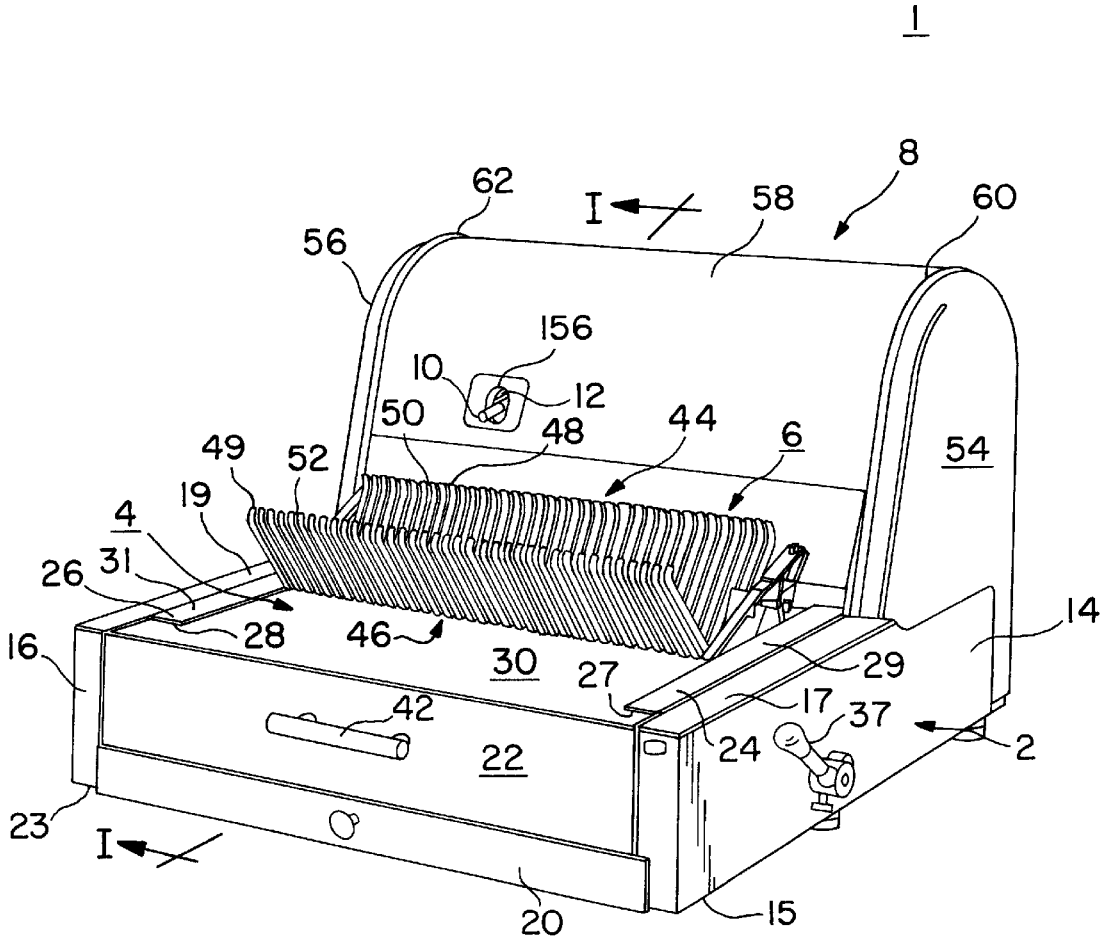
FIG. 1 is a perspective view of a bread slicer.

In the illustrated embodiment, FIG. 1 shows a bread slicer 1 including a base frame 2, a knife frame 4, a loaf tray 6, drive mechanism (not shown) and a housing 8. According to the present invention, an actuator or knob 10 is shown in an exposed position extending though aperture 12 which is disposed through housing 8. It is appreciated that knob 10 may be a control element, a dial, a lever, a button, a switch or any similar device.

Illustratively, base frame 2 comprises two upwardly extending side walls 14, 16 and a back wall 18. (See also FIGS. 4 and 5.) Side walls 14, 16 are attached to back wall 18 forming a generally coplanar frame along edges 17, 19, 21. Walls 14, 16, 18 cooperate therewith so that knife frame 4 is received within base frame 2. It is appreciated that flanges (not shown) may be provided adjacent lower edges 15, 23 of side walls 14, 16 respectively, and oriented inwardly of base frame 2 configured to provide support to removable crumb tray 20. It is also appreciated that base frame 2 can be made from conventional bread slicer materials including metal and plastic.

Figure 2:
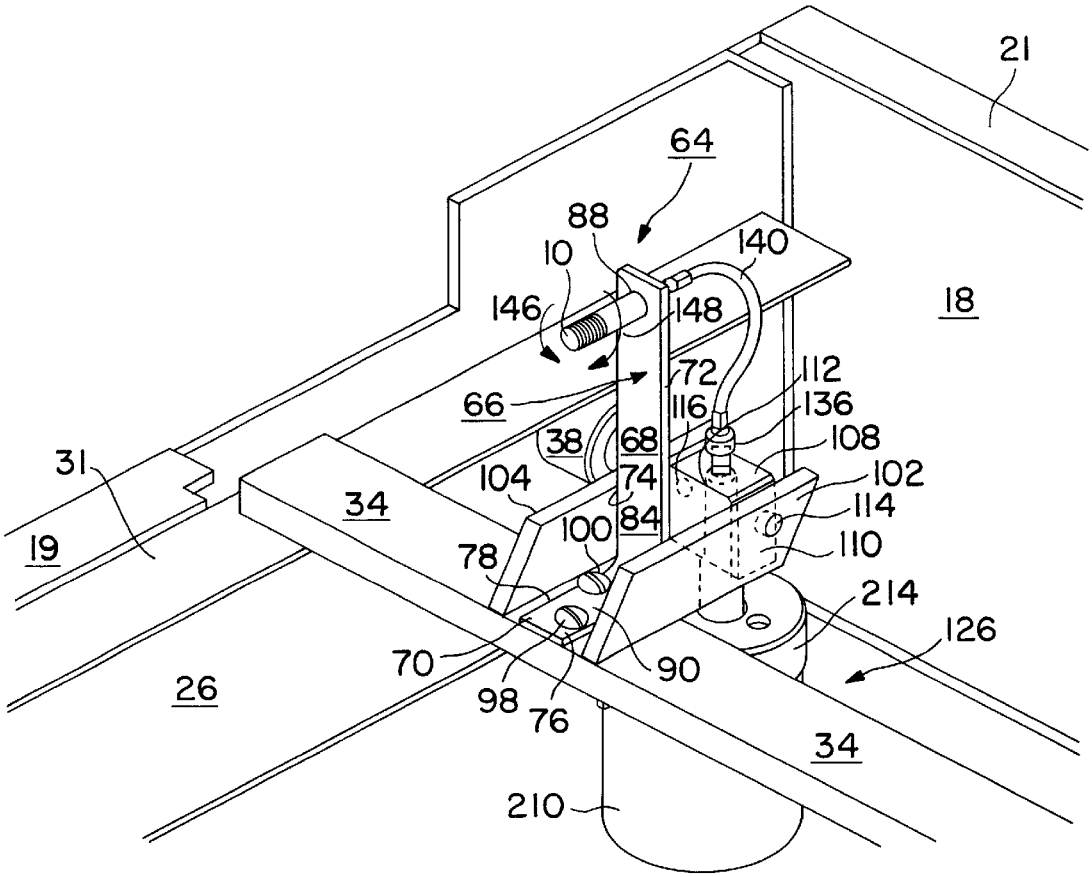
FIG. 2 is a partial perspective view of internal components of the bread slicer of FIG. 1.

Knife frame 4 is a generally rectangular member having a front wall 22 and two side walls 24, 26. Side walls 24, 26 are positioned substantially adjacent walls 14, 16 respectively, and attached to front wall 22 at their forward ends 27, 28 forming a generally coplanar frame along edges 29, 30 and 31. Walls 24, 26 are connected by a transversely extending brace 34 opposite front wall 22, as best shown in FIG. 2. A plurality of knives (not shown) are provided within knife frame 4 and oriented perpendicular to front wall 22. They are mounted to allow for sliding movement caused by the drive mechanism within the knife frame creating a cutting movement to slice the loaf. A motor assembly (not shown) to drive the movement of the knives is operably coupled to same and provided within housing 8.

Figure 4:
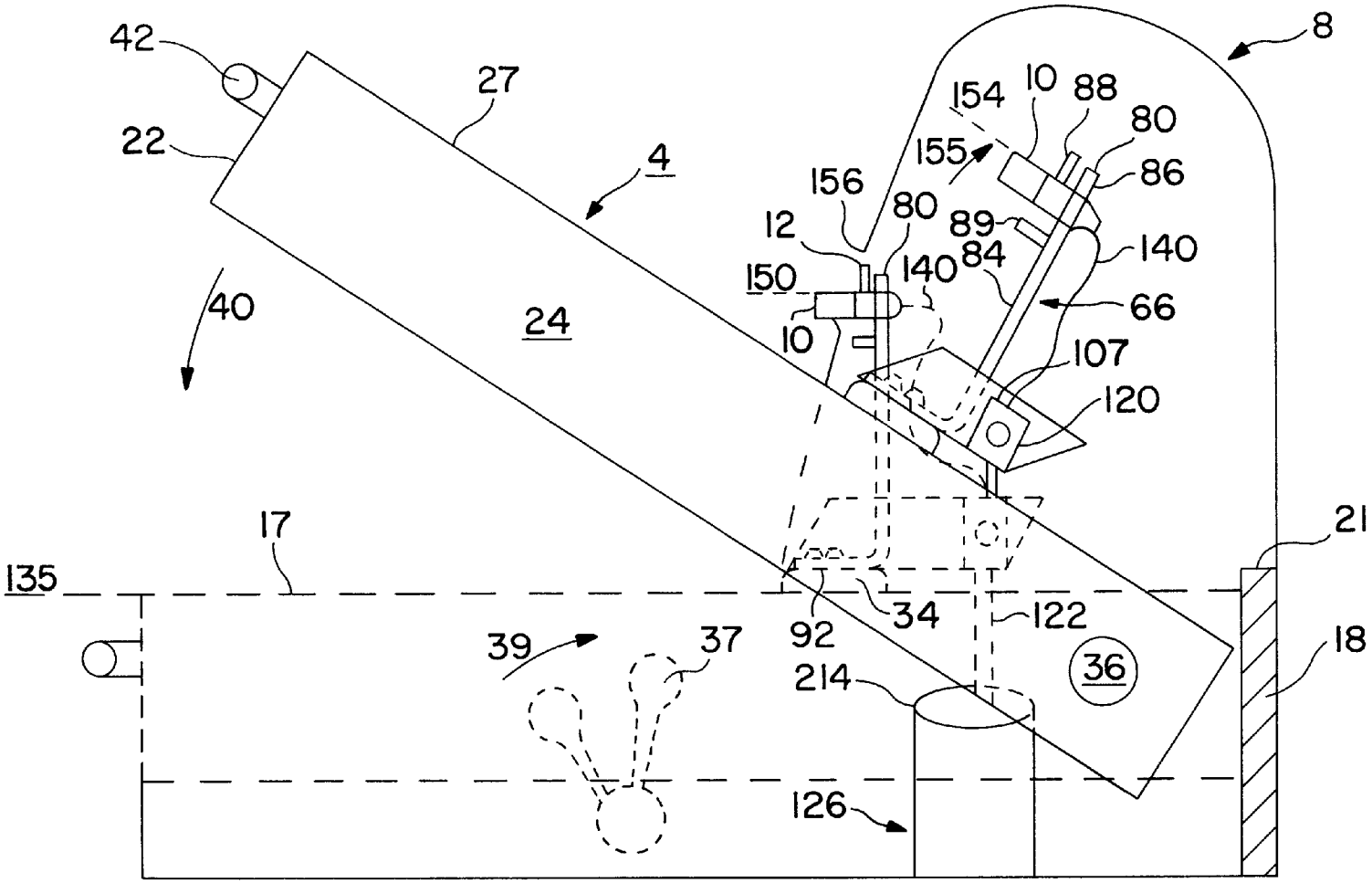
FIG. 4 is a right side elevation sectional view of the bread slicer along the line of I—I of FIG. 1.
Figure 5:
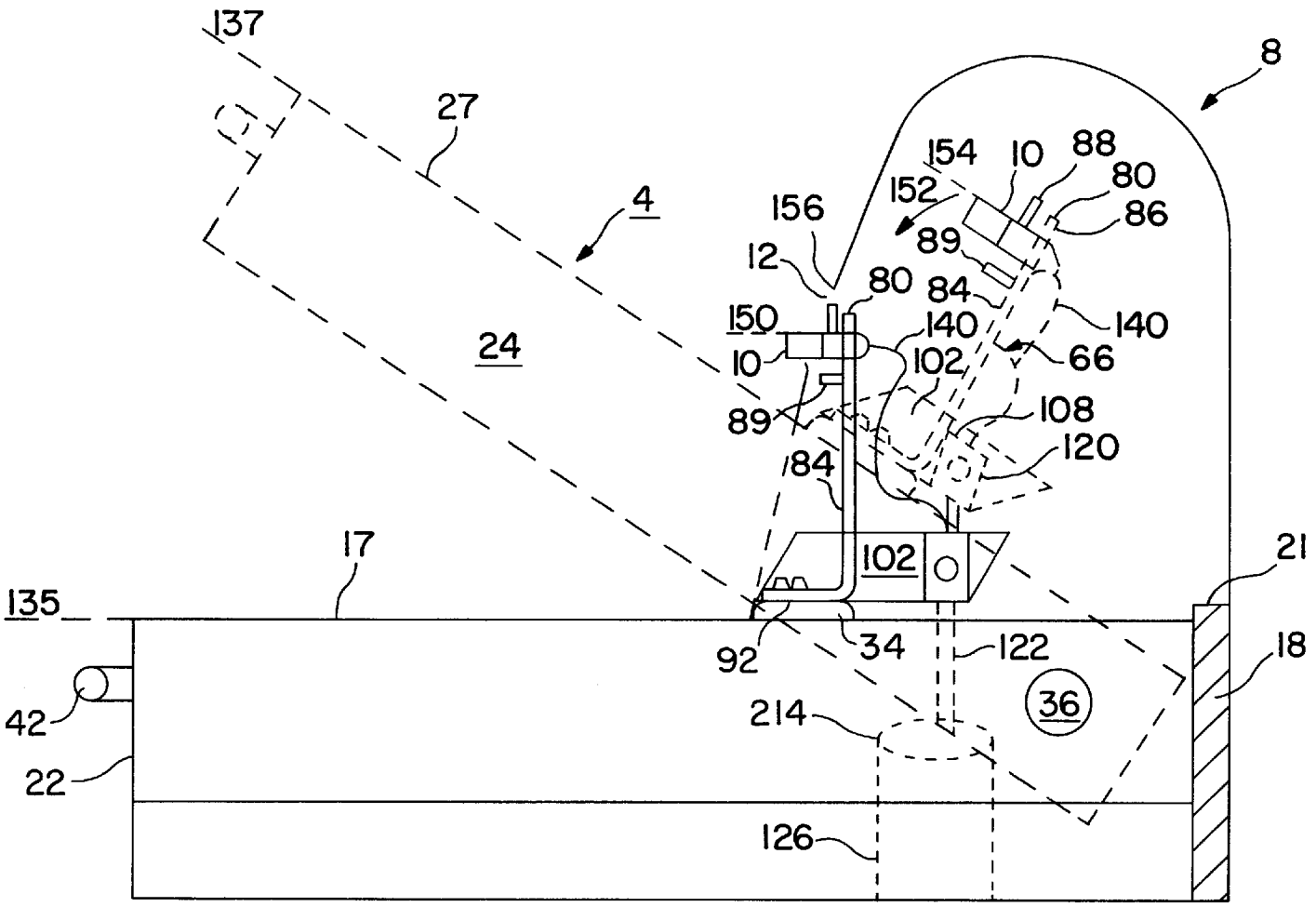
FIG. 5 is another right side elevation sectional view of the bread slicer along the line of I—I of FIG. 1.

Knife frame 4 is connected to bread slicer 1 via walls 24, 26 that are movably mounted on pivots 36, 38, respectively, and formed inwardly on walls 14, 16, respectively. See FIGS. 2–5. A handle 37 is movably attached to wall 14 and operably connected (not shown) to comb-like movable member 46 of loaf tray 6. By moving handle 37, illustratively in a direction 39, knife frame 4 is movable from an elevated position 137 as shown in FIG. 4 to a horizontal position 135 as shown in FIG. 5 and indicated by directional arrow 40. The elevated position 137 enables knife frame 4 to descend under the influence of gravity to perform the slicing operation through the loaf of bread. Knife frame 4 is configured to remain in the elevated position until the operator initiates its descent by rotating handle 37 in the direction 39. A handle 42 is attached to front panel 22 provided for the operator to grasp to move knife frame 4 to the elevated positions.

When knife frame 4 is moved to elevated position 137, it rests on the cams that are operably connected to handle 37 and comb-like movable member 46 is positioned underneath knife frame 4. This permits insertion of the loaf of bread into loaf tray 6. Loaf tray 6 illustratively comprises two comb-like members 44, 46 angularly disposed with respect to each other as shown in FIG. 1. Illustratively, member 44 is operably coupled to handle 37. Member 46 is fixedly attached to base frame 2. Each consecutive comb bristle 48 is placed opposite each comb bristle 49. Each comb bristle 48 is laterally spaced apart from each other as are comb bristles 49. Spaces 50, 52 provided between consecutive bristles 48, 49, respectively, are sized to receive the knives. As a result, as knife frame 4 descends, the knives slice the loaf of bread between consecutive bristles 48, 49, respectively, a thickness defined by the size of spaces 50, 52.

Housing 8 serves as a shroud over the electrical and mechanical components (not all shown) that operate bread slicer 1. An exemplification of such electrical and mechanical components can be seen in FIGS. 5, 6 and 8 of the '767 patent. Housing 8 is provided on base frame 2 adjacent edges 17, 19, 21 opposite front wall 22 as shown in FIGS. 1, 2 and 4. In the illustrated embodiment, housing 8 comprises upwardly extending side panels 54, 56. A cover 58 is appended to both side panels 54, 56 at edges 60 and 62, respectively, covering the mechanical components. It will be appreciated, however, that housing 8 may be a single-piece formed shroud as a substitute for side panels 54, 56 and cover 58. It is also appreciated that housing 8 may be made from any variety of conventional materials including metal or plastic.

Figure 3:
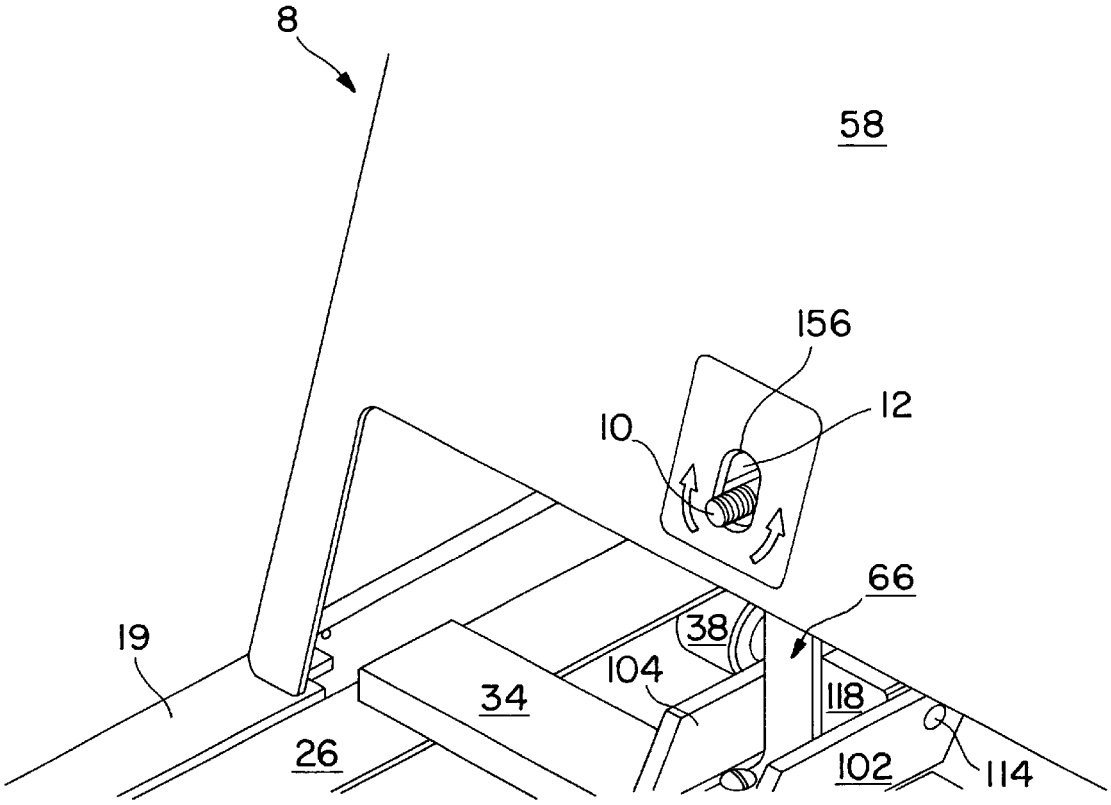
FIG. 3 is another partial perspective view of the bread slicer of FIG. 1.

Drop speed adjustment assembly 64 is shown in FIGS. 2 and 3. In the illustrated embodiment, drop speed adjustment assembly 64 comprises a bracket 66. Bracket 66 is an "L" shaped steel form having a vertical portion 68 and a horizontal portion 70, and edges 72, 74 and 76, 78, respectively. Vertical portion 68 includes first and second sides 84, 86 having an aperture 80 disposed therethrough, as best shown in FIG. 4, and through which knob 10 extends. Horizontal portion 70 also includes first and second sides 90, 92. Second side 92 is positioned adjacent brace 34. Illustratively, bolts extend through horizontal portion 70 from first side 90 through second side 92 into brace 34 thereby securing bracket 66 to same. The bolts each include a head 98, 100 used to tighten said bolts. It is appreciated that any fastener or adhesive may be used to secure bracket 64 to bread slicer 1.

Side brackets 102, 104 are attached to brace 34 extending upward therefrom on opposite sides of bracket 66. In the illustrated embodiment, side brackets 102, 104 are positioned adjacent edges 72, 74, respectively, of bracket 66. Each side of bracket 102, 104, is spaced apart from edges 72, 74, respectively, of bracket 66 to form an opening therebetween. Side brackets 102, 104 extend from brace 34 in a direction opposite from knife frame 4. A block 108 is pivotally attached to side brackets 102, 104 at sides 110, 112, respectively, and movable about pivots 114, 116 respectively. (See also FIG. 6.) Block 108 pivots relative to side brackets 102, 104 so that as knife frame 4 is elevated, block 108 will remain in generally vertical alignment with rod 122. The width of front and rear sides 118, 120 of block 108 determines the amount of opening between edges 72, 74 of bracket 66 and side brackets 102, 104, respectively.

Figure 6:
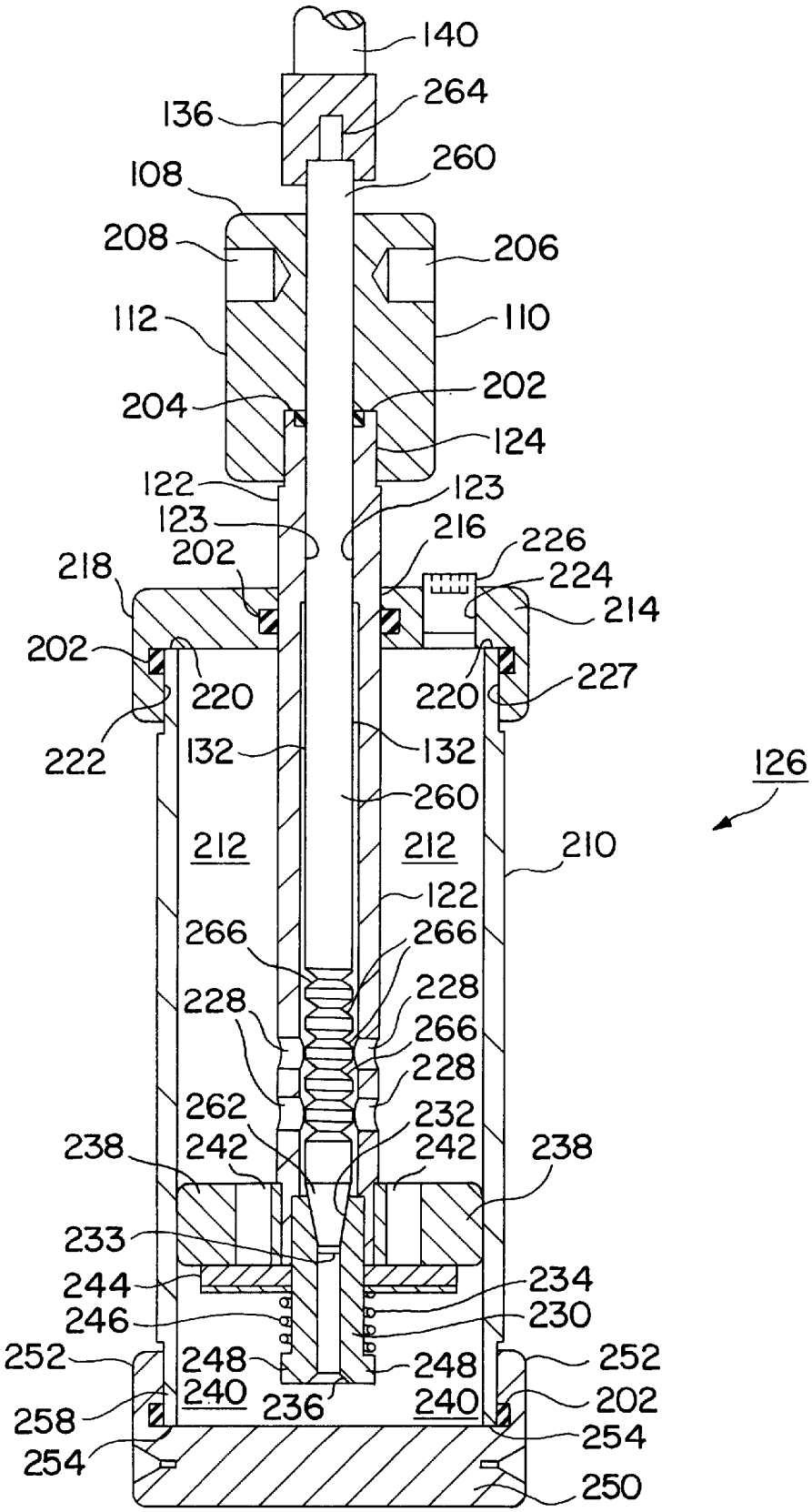
FIG. 6 is a cross-sectional view of a portion of the bread slicer of FIG. 1.

As shown in FIG. 6, block 108 is attached to rod 122 by extending same into bore 124. Illustratively, an o-ring 202 is provided adjacent bore 124 and the terminus 204 of rod 122. Bores 206 and 208 are disposed in block 108 at sides 110, 112, respectively, and configured to receive pivots at 114, 116.

A damper or dashpot 126 includes a cylindrical body 210 defining a chamber 212. A cap 214 comprises an aperture 216 through which rod 122 extends. Another o-ring 202 is positioned adjacent aperture 216 and rod 122. A flange 218 is appended to cap 214 and is positioned adjacent cylinder 210 at first end 220. An o-ring 202 is also positioned adjacent cylinder 210 and inner surface 222 of flange 218 to seal same. A refill hole 224 is disposed in cap 214 extending to chamber 212. This allows fluid to fill in chamber 212. A plug 226 is configured to be removably fitted in hole 224 preventing fluid contained in chamber 212 from escaping.

Rod 122 and block 108 include coaxially aligned bores defining a hollow shaft 123. Shaft 123 has a slightly expanded diameter at 132. Inlet holes 228 are disposed through rod 122 into shaft 123. It is appreciated that several holes 228 can be disposed through rod 122, as shown in the illustrated embodiment. Opposite terminus 204, a plug 230 is fitted adjacent rod 122. Plug 230 includes a wall 232 forming a conically shaped opening 233. Opening 233 is coaxially aligned with a narrow shaft 234 disposed through plug 230 to an opening 236 and into a chamber portion 240. In the illustrated embodiment, opening 236 has a wider diameter than narrow shaft 234.

A plunger 238 is provided about rod 122 and against cylinder 210 forming chamber portion 240. Plunger 238 includes bleed holes 242 disposed between chamber 212 and chamber portion 240. It is appreciated that any number of bleed holes 242 may be used. A cover 244 is configured to shroud the openings of bleed holes 242 adjacent chamber portion 240. A spring 246 is provided adjacent cover 244. A ridge 248 is appended to plug 230 and configured to provide the bias direction of spring 246 on cover 244 against holes 242. When cover 244 is biased against holes 242 fluid is prevented from transferring between chamber 240 and chamber portion 212 through said holes 242. As knife frame 4 is lowered, plunger 238 is lowered as well such that the fluid pressure acts along with the spring bias cover 244 prevents fluid from transferring between chambers through holes 242. As knife frame 4 is raised plunger 238 is also raised. Fluid pressure having a greater force than the spring bias acts against the spring such that cover 244 allows fluid to transfer between chambers 212, 240 through holes 242. Allowing fluid transfer through holes 242 makes raising knife frame 4 an easier task for the operator.

A base 250 comprises a flange 252 appended to base 250 and positioned adjacent cylinder 210 at second end 254. An o-ring 202 is positioned adjacent cylinder 210 and inner surface 258 of flange 252 to seal same.

A valve needle 260 is extended through shaft 123 in communication with conical shaped opening 233. Valve needle 260 is a rod shaped structure having a conically shaped head 262 complimentary to wall 232. In the illustrated embodiment, portions of valve needle 260 comprises concave shaped portions 266. Fluid, typically provided in chamber 240 enters through opening 236 of plug 230, enters chamber 212 via opening 233 around the conical portion of valve needle 260, and exiting through holes 228. Fluid is then allowed to flow past head 262 and into chamber 240 through opening 233, narrow shaft 234 and opening 236. The displacement of fluid between chambers 240 and 212 is what allows piston 238 and ultimately rod 122 to move. The distance spaced apart between head 262 and opening 233 determines the rate the fluid will move between chambers. If the distance is large the rate will be high. If the distance is small the rate will be low. The slower the rate the slower the plunger will move. Dashpot 126 will subsequently cause knife frame 4 to descend at a slower rate. The faster the rate the faster the plunger will move. Dashpot 126 will subsequently cause knife frame 4 to descend at a less slower rate. The needle valve is by-passed when the piston is moved upward by letting the fluid transfer from chambers 212 to 240 through holes 242.

A bi-directional flexible shaft 140 is operably coupled to coupling 264, by link 136, as shown in FIGS. 2 and 6. Link 136 is affixed to shaft 140 and can be attached to coupling 264 by a set screw, welding, adhesive (not shown). Depending on which direction knob 10 is rotated, shaft 140 is caused to move forward or backward. If shaft 140 is moved forward, rod 122 is moved forward as well. If shaft 140 is moved backward, rod 122 is moved backward as well.

Knob 10 extends through aperture 80 when knife frame 4 is in the horizontal position 135. In the illustrated embodiment, rotating knob 10 in direction 146 operates bi-directional flexible shaft 140 causing shaft 140 to move backward thus causing head 262 to be spaced apart from wall 232 allowing fluid to flow between chambers at a faster rate. This causes knife frame 4 to descend at this faster rate as previously discussed. Knob 10 may continue to rotate in direction 146 until stop 88 engages stop 89. At this engagement, knob 10 has moved head 262 to its most spaced apart position from wall 232. Conversely, rotating knob 10 in direction 148 operates bidirectional flexible shaft 140 to move forward, thus causing head 262 to be less spaced apart from wall 232 forcing fluid to flow between chambers at an even slower rate. This causes knife frame 4 to descend at this even slower rate. Knob 10 may continue to rotate in direction 148 until stop 88 engages stop 89. At this engagement, knob 10 has moved head 262 to its least spaced apart position from wall 232.

As shown in FIGS. 4 and 5, drop speed adjustment assembly 64 is attached to brace 34 which itself is attached to knife frame 4, and thus, movable as knife frame 4 is movable. Drop speed adjustment assembly 64 is movable between a first position 150 in concert with knife frame 4 from a direction indicated by reference number 152 and a second position 154 from a direction indicated by reference number 155.

Knob 10 is shown in FIG. 3, in the exposed position extending though aperture 12 disposed through housing 8, as previously discussed. In the illustrated embodiment, aperture 12 is a vertically elongated shaped opening. Aperture 12 is configured such that the edge 156 does not interfere with knob 10 as it is moving in direction 155. As drop speed adjustment assembly 64 moves from first position 150 to second position 154, knob 10 moves into housing 8 and is no longer accessible to the operator. The operator will only be able to move knob 10 while knife tray 4 is in horizontal position 135 as shown in FIGS. 4 and 5. This reduces the risk of injury to an operator who might otherwise attempt to move knob 10 while knife frame 4 is in the elevated position.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as set forth in the attached claims.

We claim:

1. A bread slicer comprising:

a cutting assembly movable between raised and lowered positions;

a variable rate control assembly in operable communication with the cutting assembly and configured to selectively vary a rate of movement of the cutting assembly;

and a housing having a wall; the variable rate control assembly configured to be concealed by the wall when the cutting assembly is in the raised position preventing an operator from selectively varying the rate of movement of the cutting assembly and to have at least a portion of the variable rate control assembly exposed when the cutting assembly is in the lowered position allowing the operator to selectively vary the rate of movement of the cutting assembly.

2. The bread slicer of claim 1, further comprising an actuator provided in operable communication with the variable rate control assembly to allow the operator to selectively vary the rate of movement of the cutting assembly.

3. The bread slicer of claim 2, wherein the actuator is a knob.

4. The bread slicer of claim 2, wherein the housing comprises a cover, the cover having an aperture disposed therethrough.

5. The bread slicer of claim 4, wherein the actuator is at least partially extended through the aperture when the cutting assembly is in the lowered position, and concealed by the cover when the cutting assembly is in the raised position.

6. The bread slicer of claim 5, wherein the actuator is movable to a plurality of positions such that each of said plurality of positions selectively varies the rate of movement of the cutting assembly from the raised position to the lowered position.

7. The bread slicer of claim 6, wherein the variable rate control assembly is attached to the cutting assembly.

8. A bread slicer comprising:

a cutting assembly movable between raised and lowered positions;

a damper coupled to the cutting assembly and configured to affect a rate of movement of the cutting assembly;

a variable rate control assembly having an actuator coupled with the damper to selectively affect the rate of movement of the cutting assembly;

and a housing having a wall; the variable rate control assembly configured to be concealed by the wall when the cutting assembly is in the raised position preventing an operator from selectively varying the rate of movement of the cutting assembly and to have at least a portion of the variable rate control assembly exposed when the cutting assembly is in the lowered position allowing the operator to selectively vary the rate of movement of the cutting assembly.

9. The bread slicer of claim 8, wherein the damper is a dashpot.

10. The bread slicer of claim 9, wherein the dashpot has a first portion and a second portion and the variable rate control assembly is configured to selectively vary a rate by which fluid is distributed between said portions.

11. The bread slicer of claim 9, wherein the actuator is in operable communication with the variable rate control assembly to allow the operator to selectively vary the rate of movement of the cutting assembly by selectively varying a rate of movement by which fluid is distributed between portions of the dashpot.

12. The bread slicer of claim 11, wherein the actuator is a knob.

13. The bread slicer of claim 11, further comprising a shaft in operable communication with the actuator at a first end and with the dashpot at a second end such that the actuator communicates with the dashpot via the shaft to selectively vary the rate by which fluid is distributed between said portions.

14. The bread slicer of claim 13, wherein the shaft is a flexible shaft.

15. The bread slicer of claim 13, further comprising a valve operably coupled to the second end of the shaft and the dashpot such that as the shaft moves, the valve is caused to move to selectively vary the rate by which fluid is distributed between said portions.

16. The bread slicer of claim 11, wherein the cover having an aperture disposed therethrough.

17. The bread slicer of claim 16, wherein the actuator is at least partially extended through the aperture when the cutting assembly is in the lowered position, and concealed by the cover when the cutting assembly is in the raised position.

18. The bread slicer of claim 17, wherein the variable rate control assembly is attached to the cutting assembly.

19. A bread slicer comprising:

a cutting assembly movable between raised and lowered positions; and a dashpot coupled to the cutting assembly and configured to affect a rate of movement of the cutting assembly;

a variable rate control assembly in operable communication with the dashpot, the variable rate control assembly comprising:

an actuator movably attached to the cutting assembly, a valve in operable communication with the dashpot and configured to vary the rate of movement of the cutting assembly, and a shaft in operable communication with the actuator and the valve such that selective movement of the actuator causes the valve to selectively vary the rate of movement of the cutting assembly;

a housing having a wall; the actuator configured to be concealed by the wall when the cutting assembly is in the raised position preventing an operator from selectively varying the rate of movement of the cutting assembly and to have at least a portion of the actuator exposed when the cutting assembly is in the lowered position allowing the operator to selectively vary the rate of movement of the cutting assembly.

* * * * *